US010494948B2

(12) United States Patent
Dutta et al.

(10) Patent No.: US 10,494,948 B2
(45) Date of Patent: Dec. 3, 2019

(54) IMPINGEMENT INSERT

(71) Applicant: GENERAL ELECTRIC COMPANY, Schenectady, NY (US)

(72) Inventors: Sandip Dutta, Greenville, SC (US); Joseph Anthony Weber, Greenville, SC (US); Benjamin Paul Lacy, Greer, SC (US)

(73) Assignee: GENERAL ELECTRIC COMPANY, Schenectady, NY (US)

( * ) Notice: Subject to any disclaimer, the term of this patent is extended or adjusted under 35 U.S.C. 154(b) by 270 days.

(21) Appl. No.: 15/590,512

(22) Filed: May 9, 2017

(65) Prior Publication Data

US 2018/0328224 A1 Nov. 15, 2018

(51) Int. Cl.

*F01D 25/12* (2006.01)
*F01D 9/04* (2006.01)
*F01D 5/18* (2006.01)

(52) U.S. Cl.

CPC ..... *F01D 25/12* (2013.01); *F01D 5/189* (2013.01); *F01D 9/041* (2013.01); *F05D 2220/32* (2013.01); *F05D 2230/31* (2013.01); *F05D 2250/21* (2013.01); *F05D 2260/201* (2013.01); *F05D 2260/2212* (2013.01); *F05D 2260/2214* (2013.01); *F05D 2260/22141* (2013.01)

(58) Field of Classification Search

CPC ..... F05D 2220/32; F05D 2230/31; F05D 2250/21; F05D 2260/201; F05D 2260/202; F05D 2260/2212; F05D 2260/2214; F05D 2260/22141; F01D 5/187; F01D 5/188; F01D 5/189; F01D 25/12; Y02T 50/676; F23R 2900/03044

USPC ..... 416/96 A

See application file for complete search history.

(56) References Cited

U.S. PATENT DOCUMENTS 3,240,468 A * 3/1966 Watts ..... F01D 5/183 415/115
3,647,316 A * 3/1972 Moskowitz ..... F01D 5/183 416/231 R
4,064,300 A * 12/1977 Bhangu ..... B32B 3/266 428/120
4,105,364 A * 8/1978 Dodd ..... F01D 5/189 415/115
4,446,693 A * 5/1984 Pidcock ..... F23R 3/002 60/757

(Continued)

FOREIGN PATENT DOCUMENTS

DE 4447515 C2 * 2/1999 ..... F01D 5/186
EP 1188902 A1 * 3/2002 ..... F01D 5/189

(Continued)

*Primary Examiner* — John M Zaleskas

(74) *Attorney, Agent, or Firm* — McNees Wallace & Nurick LLC

(57) ABSTRACT

An airfoil including a leading edge, a trailing edge, a pressure side, a suction side, and an internal impingement cavity. An impingement insert is located within the impingement cavity. The impingement insert includes at least one impingement cooling hole spaced along a first face of the impingement insert and at least one impingement fin, having a base and a tip opposite the base, spaced along the first face of the impingement insert. The at least one impingement fin is spaced apart from the at least one impingement cooling hole.

18 Claims, 10 Drawing Sheets

(56) References Cited

U.S. PATENT DOCUMENTS 4,543,781 A * 10/1985 Rice ..... F01K 23/10 60/730
5,328,331 A * 7/1994 Bunker ..... F01D 5/187 415/115
5,340,274 A * 8/1994 Cunha ..... F01D 5/182 415/114
5,352,091 A * 10/1994 Sylvestro ..... F01D 5/189 416/96 A
5,361,828 A * 11/1994 Lee ..... F01D 5/187 165/109.1
5,467,815 A * 11/1995 Haumann ..... F01P 1/02 165/109.1
5,586,866 A * 12/1996 Wettstein ..... F01D 5/189 416/96 A
5,993,156 A * 11/1999 Bailly ..... F01D 5/187 415/115
6,000,908 A * 12/1999 Bunker ..... F01D 5/189 165/908
6,183,192 B1 * 2/2001 Tressler ..... F01D 5/189 415/115
6,237,344 B1 * 5/2001 Lee ..... F01D 5/186 165/908
6,439,846 B1 * 8/2002 Anderson ..... F01D 5/187 416/96 A
6,820,682 B2 * 11/2004 Hayashi ..... B60H 1/025 165/109.1
6,929,058 B2 * 8/2005 Liu ..... F28F 3/12 165/104.33
7,815,417 B2 * 10/2010 Somanath ..... F01D 5/147 415/116
8,167,537 B1 * 5/2012 Plank ..... F01D 5/147 415/115
8,322,988 B1 * 12/2012 Downs ..... F01D 5/147 416/96 A
8,360,726 B1 * 1/2013 Liang ..... F01D 5/187 416/241 R
8,777,569 B1 * 7/2014 Liang ..... F01D 5/188 416/96 A
8,939,706 B1 * 1/2015 Lee ..... F01D 11/122 415/1
9,133,717 B2 * 9/2015 Nakamata ..... F01D 5/186
2002/0062945 A1 * 5/2002 Hocker ..... F01D 5/189 165/53
2003/0031555 A1 * 2/2003 Noe ..... F01D 5/189 415/115
2003/0091427 A1 * 5/2003 Powis ..... F01D 5/189 415/1
2003/0113201 A1 * 6/2003 Powis ..... F01D 5/189 415/1
2005/0135921 A1 * 6/2005 Busch ..... F01D 5/189 415/115
2005/0232769 A1 * 10/2005 Lee ..... F01D 5/187 416/97 R
2009/0324385 A1 * 12/2009 Liang ..... F01D 5/187 415/115
2010/0247329 A1 * 9/2010 Morgan ..... F01D 5/147 416/97 R
2011/0164960 A1 * 7/2011 Maldonado ..... F01D 5/186 415/115
2014/0110559 A1 * 4/2014 Lee ..... B22C 9/10 249/175
2014/0112799 A1 * 4/2014 Lee ..... F01D 5/187 416/97 R
2014/0230442 A1 * 8/2014 Yokota ..... F23R 3/005 60/760
2014/0238028 A1 * 8/2014 Yamane ..... F01D 5/189 60/752
2014/0290257 A1 * 10/2014 Okita ..... F01D 5/189 60/752
2015/0086408 A1 * 3/2015 Kottilingam ..... B22F 5/04 419/5
2015/0139814 A1 * 5/2015 Horiuchi ..... F01D 5/187 416/97 R
2015/0159489 A1 * 6/2015 Lee ..... F01D 5/189 416/97 R
2015/0198050 A1 * 7/2015 Lee ..... F01D 5/188 415/115
2015/0226085 A1 * 8/2015 Spangler ..... F01D 25/12 60/806
2015/0267557 A1 * 9/2015 Facchinetti ..... F01D 5/189 416/95
2016/0102563 A1 * 4/2016 Spangler ..... F01D 5/189 415/115
2016/0222793 A1 * 8/2016 Snyder ..... F01D 5/189
2016/0222796 A1 * 8/2016 Spangler ..... F01D 5/186
2016/0230564 A1 * 8/2016 Mongillo, Jr. ..... F01D 5/186
2016/0333735 A1 * 11/2016 Bunker ..... F23R 3/005
2016/0348536 A1 * 12/2016 Lacy ..... F01D 5/189
2017/0030201 A1 * 2/2017 Rao ..... F23R 3/002
2017/0051612 A1 * 2/2017 Sezer ..... F01D 5/189
2017/0058679 A1 * 3/2017 Spangler ..... F01D 9/041
2017/0067363 A1 * 3/2017 Lacy ..... F01D 25/12
2017/0067636 A1 * 3/2017 Lacy ..... F23R 3/06
2017/0096900 A1 * 4/2017 Bunker ..... F01D 5/141
2017/0167270 A1 * 6/2017 Itzel ..... B33Y 10/00
2017/0175577 A1 * 6/2017 Dutta ..... F01D 25/12
2017/0191417 A1 * 7/2017 Bunker ..... F23R 3/005
2017/0226892 A1 * 8/2017 Lacy ..... F01D 25/12
2017/0268348 A1 * 9/2017 Lee ..... F01D 5/189
2017/0356299 A1 * 12/2017 Dutta ..... F01D 5/189
2017/0356341 A1 * 12/2017 Dutta ..... F01D 5/189
2018/0135424 A1 * 5/2018 Barker ..... F01D 5/186
2018/0135426 A1 * 5/2018 Barker ..... F01D 5/187
2018/0149028 A1 * 5/2018 Dutta ..... F01D 5/189
2018/0163545 A1 * 6/2018 Bang ..... F01D 5/18

FOREIGN PATENT DOCUMENTS

JP 55104507 A * 8/1980 ..... F01D 5/189
JP 04265403 A * 9/1992
JP 2009041433 A * 2/2009 ..... F01D 5/187
JP 2010174688 A * 8/2010 ..... F01D 5/187
JP 2012202342 A * 10/2012
WO WO-2011020485 A1 * 2/2011 ..... F01D 5/189

* cited by examiner

IMPINGEMENT INSERT

FIELD OF THE INVENTION

The present invention is directed to articles for thermal management of turbine components. More particularly, the present invention is directed to articles for thermal management of turbine components including impingement flow modification structures.

BACKGROUND OF THE INVENTION

Gas turbines airfoils such as nozzles are subjected to intense heat and external pressures in the hot gas path. These rigorous operating conditions are exacerbated by advances in the technology, which may include both increased operating temperatures and greater hot gas path pressures. As a result, gas turbine airfoils are sometimes cooled by flowing a fluid through a manifold inserted into the core of the airfoil. The fluid then exits the manifold through impingement holes into a post-impingement cavity, and subsequently exits the post-impingement cavity through apertures in the exterior wall of the airfoil, forming a film layer of the fluid on the exterior of the airfoil.

However, crossflow in the post-impingement cavity, and non-optimized flow paths inhibit fluid cooling in the post-impingement cavity. The rigorous operating conditions, materials and manufacturing techniques have maintained or even exacerbated crossflow in the post-impingement cavity, laminar flow of the cooling fluid and non-optimized flow paths.

BRIEF DESCRIPTION OF THE INVENTION

In an exemplary embodiment, a component includes an airfoil having a leading edge, a trailing edge, a pressure side, a suction side, and an internal impingement cavity. An impingement insert is secured within the impingement cavity. The impingement insert includes at least one impingement cooling holes spaced along a first face of the impingement insert and at least one impingement fins, having a base and a tip opposite the base, spaced along the first face of the impingement insert. The at least one impingement fins are spaced apart from the impingement cooling holes.

In an exemplary embodiment, an impingement insert includes at least one impingement cooling hole spaced along a first face of the impingement insert; at least one impingement fin, having a base and a tip opposite the base, spaced along the first face of the impingement insert. The at least one impingement fin is spaced apart from the at least one impingement cooling hole.

In an exemplary embodiment, a component, includes an airfoil having an internal surface, an external surface, a leading edge, a trailing edge, a pressure side, a suction side, and an internal impingement cavity defined by the internal surface. The component also includes an impingement insert, the impingement insert having at least one impingement cooling hole spaced along a first face of the impingement insert and at least one impingement fin, having a base and a tip opposite the base, spaced along the first face of the impingement insert. The at least one impingement fin is spaced apart from the at least one impingement cooling holes.

In an exemplary embodiment, a method of making an impingement insert, including, providing an impingement insert having at least one impingement cooling hole spaced along a first face of the impingement insert. The method also including forming at least one impingement fin, having a base and a tip opposite the base, spaced along the first face of the impingement insert by additive manufacturing, wherein the at least one impingement fin is spaced apart from the at least one impingement cooling hole.

Other features and advantages of the present invention will be apparent from the following more detailed description, taken in conjunction with the accompanying drawings which illustrate, by way of example, the principles of the invention.

BRIEF DESCRIPTION OF THE DRAWINGS

Wherever possible, the same reference numbers will be used throughout the drawings to represent the same parts.

DETAILED DESCRIPTION OF THE INVENTION

Provided is an article useful as a component of a turbine. Embodiments of the present disclosure, for example, in comparison to concepts failing to include one or more of the features disclosed herein, increase the cooling effectiveness of cooling features, provide more uniform coolant flow, increase cooling efficiency, increase wall temperature consistency, increase cooling surface area with decreased fluid flow, decrease or eliminate over cool regions, provide varied heat transfer within the article, facilitate the use of increased system temperatures, and combinations thereof.

Figure 1:
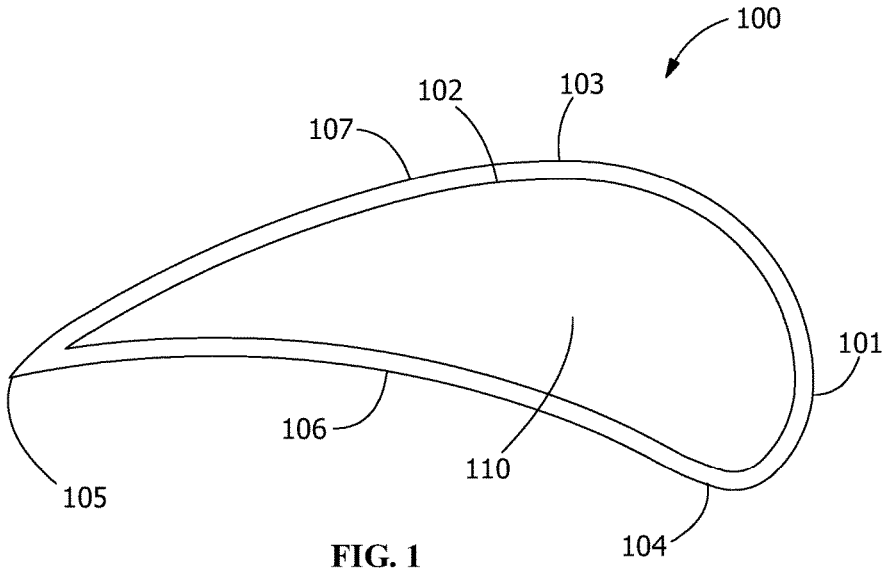
FIG. 1 is a side view of an airfoil, according to an embodiment.
Figure 2:
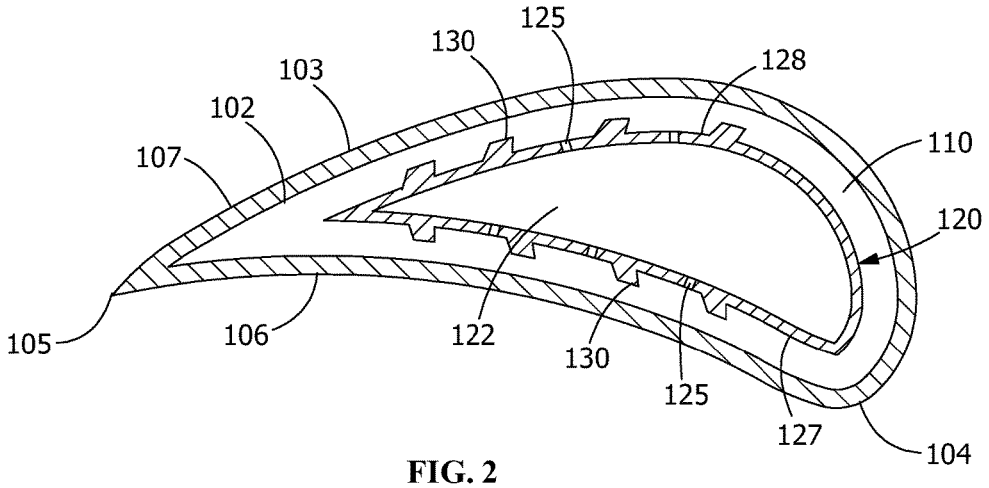
FIG. 2 is a side view of an airfoil with an impingement insert, according to an embodiment.

Referring to FIGS. 1 and 2, in an embodiment, a component 100 including an airfoil 101 having an internal surface 102, an external surface 103, a leading edge 104, a trailing edge 105, a pressure side 106, a suction side 107, and an internal impingement cavity 110 defined by the internal surface 102. The airfoil 101 is configured to receive a fluid from an external source (e.g. a turbine system) and direct the fluid into the impingement cavity 110. The airfoil 101 is additionally configured to discharge the fluid from the impingement cavity 110 to an external environment. An impingement insert 120 is secured within the impingement cavity 110. The impingement insert 120 includes an internal region 122, at least one impingement cooling holes 125 spaced along a first face 127 of the impingement insert 120, and at least one impingement fins 130, spaced along the first face 127 of the impingement insert 120. The at least one impingement fins 130 are spaced apart from the at least one impingement cooling holes 125. The impingement insert 120 is configured to allow the received fluid to move between the internal region 122 of the impingement insert 120 and the impingement cavity 110 via the at least one impingement cooling holes 125.

In some embodiments, the impingement insert 120 additionally includes a plurality of impingement cooling holes 125 spaced along a second face 128 of the impingement insert 120 and at least one impingement fins 130, spaced along the second face 128 of the impingement insert. The at least one impingement fins 130 are spaced apart from the at least one impingement cooling holes 125.

The received fluid is typically at a temperature lower than a temperature on the external surface 103 of the airfoil 101. The interaction between the fluid and the surfaces of the airfoil 101 and impingement insert 120 provides a mechanism to redistribute heat throughout the component 100 to obtain a more uniform temperature distribution throughout the component 100. A more uniform temperature distribution can reduce thermal stress and increase the component 100 service life.

Figure 3:
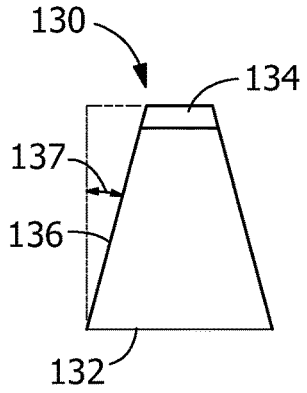
FIG. 3 is a side view of an impingement fin, according to an embodiment.
Figure 4:
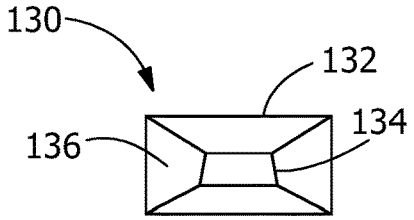
FIG. 4 is a top view of an impingement fin, according to an embodiment.

Referring to FIGS. 3 and 4, in an embodiment, the impingement fin 130 includes a base 132, a tip 134 opposite the base 132 and at least one side 136 between the base 132 and tip 134. In some embodiments, the base 132 is rectangular. In some embodiments, the base 132 may include a plurality of bases having differing shapes. In some embodiments, a plurality of bases may be attached to the impingement fin 130 at a plurality of angles. In an embodiment, a width of the base 132 of the impingement insert 120 is between 0.5 millimeters to 2.0 millimeters. In some embodiments, the base 132 and the tip 134 are both rectangular. In some embodiments, the at least one side 136 may be tapered from the base 132 to the tip 134 of the impingement fin 130. In some embodiments, an angle of the taper 137 is between 3 degrees and 10 degrees, between 4 degrees and 6 degrees, and/or about 5 degrees.

Figure 5:
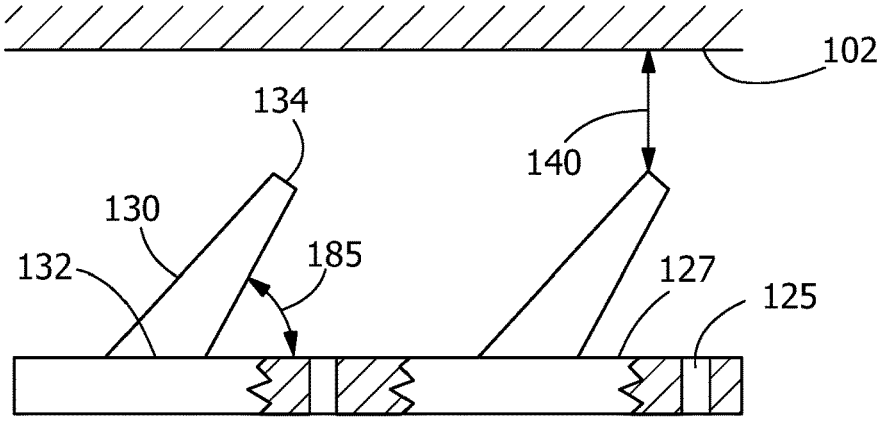
FIG. 5 is a side view of a surface of the impingement insert, according to an embodiment.
Figure 6:
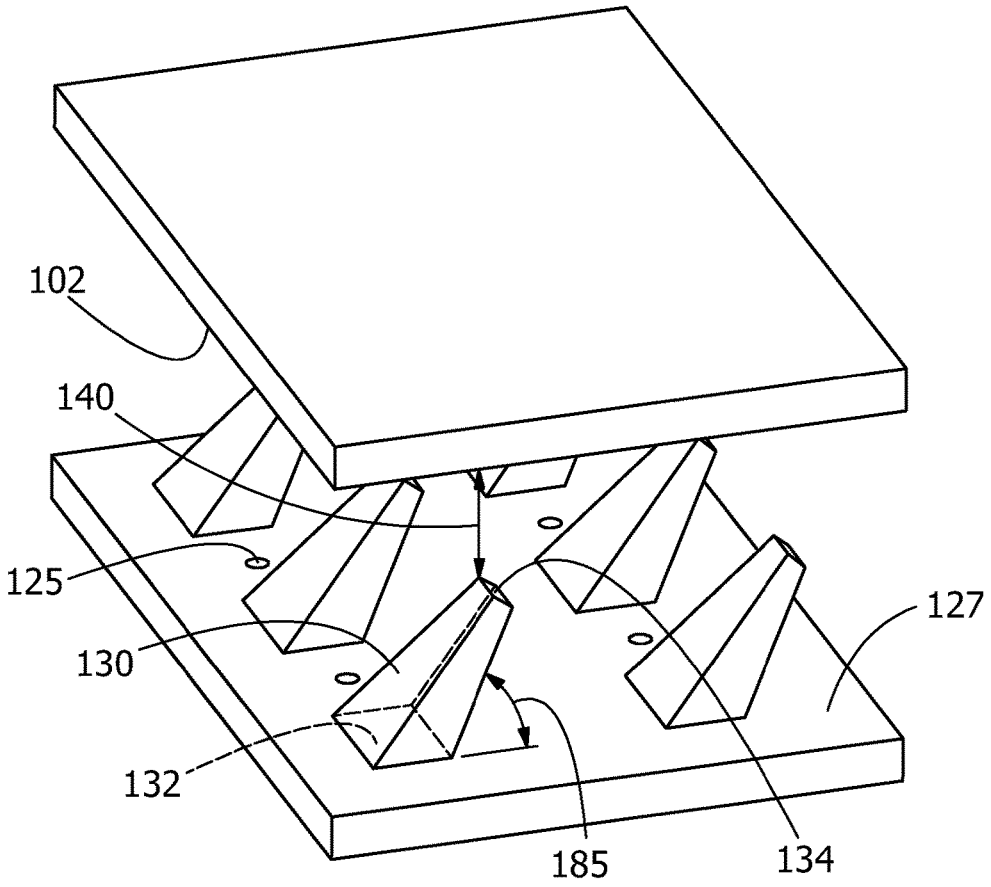
FIG. 6 is a side view of a surface of the impingement insert, according to an embodiment.

Referring to FIGS. 5 and 6, in an embodiment, the impingement fins 130 are attached to the impingement insert 120 in a spaced apart configuration from the cooling holes 125. In some embodiments, the impingement fins 130 extend from the impingement insert 120 at an angle 185. Angled impingement fins 130 increase recirculation of the fluid between first face 127 and the impingement insert 120. The angled impingement fins 130 also increase the surface area of the impingement insert 120 for heat transfer. The increased surface area and the increased interaction of the fluid with the materials of the impingement fins 130 and first face 127 can increase the heat transfer between the fluid and the impingement insert 120 thereby reducing the amount of fluid needed to regulate the temperature. In some embodiments, a heat transfer coefficient is increased by at least 10 percent, up to about 20 percent, and combinations thereof. In some embodiments, the angle 185 is greater than about 30 degrees, greater than about 40 degrees, about 45 degrees, less than about 50 degrees, less than about 60 degrees and combinations thereof.

In some embodiments, the tip 134 of the impingement fin 130 is spaced apart from the internal surface 102 of the airfoil 101. In an embodiment, a clearance 140 between the tip 134 of the at least one impingement fin 130 and the internal surface 102 of the airfoil 101 is between 0.5 millimeters and 2.0 millimeters.

In some embodiments, the base 132 of the impingement fin 130 may be attached to the impingement insert 120 by welding, mechanical, brazing, laser welding, friction welding, ultrasonic welding, additive manufacturing, and combinations thereof. In an embodiment, the impingement fin 130 is attached by additive manufacturing. In an embodiment, the impingement fin 130 is integral to the impingement insert 120. In an embodiment, the impingement fin 130 is formed by additive manufacturing integral to the impingement insert 120.

Figure 7:
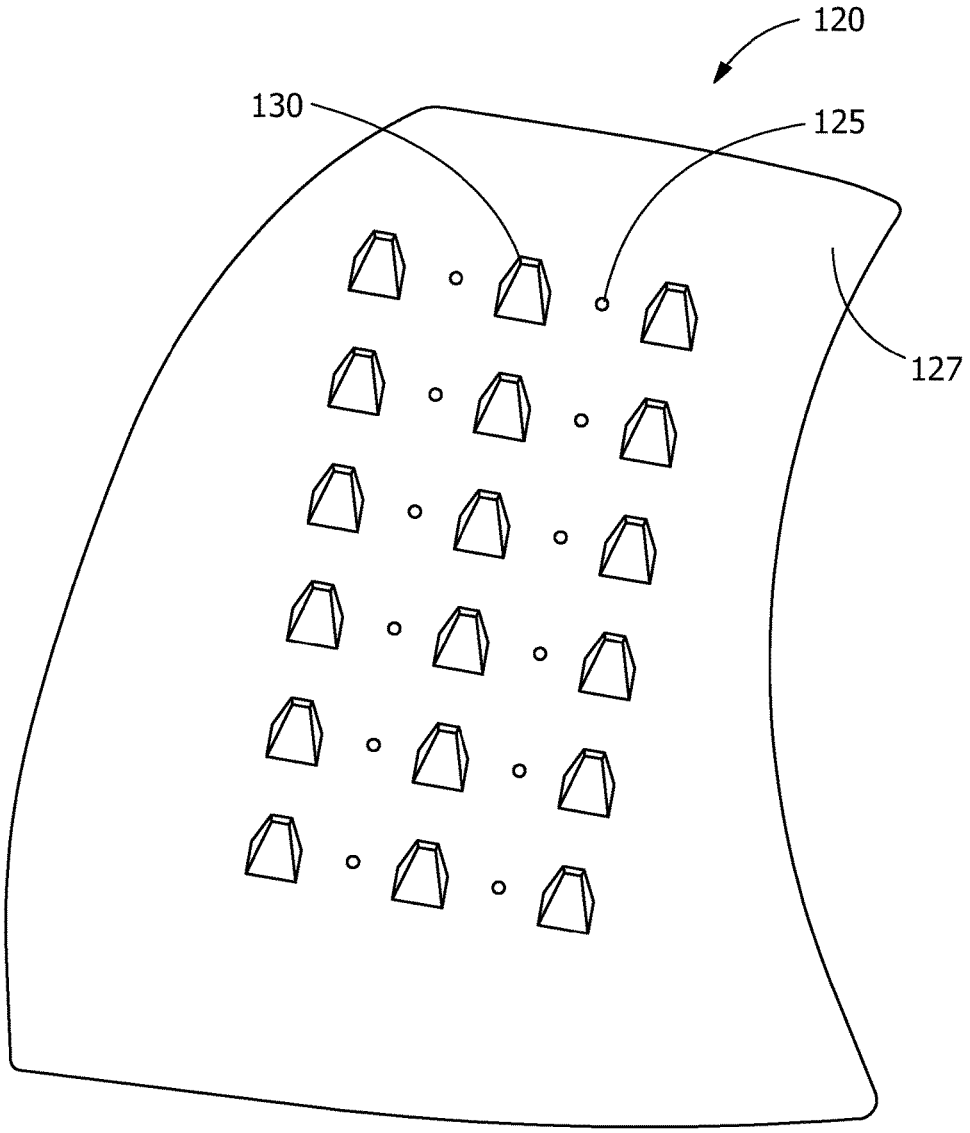
FIG. 7 is a top view of a surface of the impingement insert, according to an embodiment.

Referring to FIG. 7, in an embodiment, the impingement fins 130 and impingement cooling holes 125 are substantially aligned in single rows on the first face 127 of the impingement insert 120.

Figure 8:
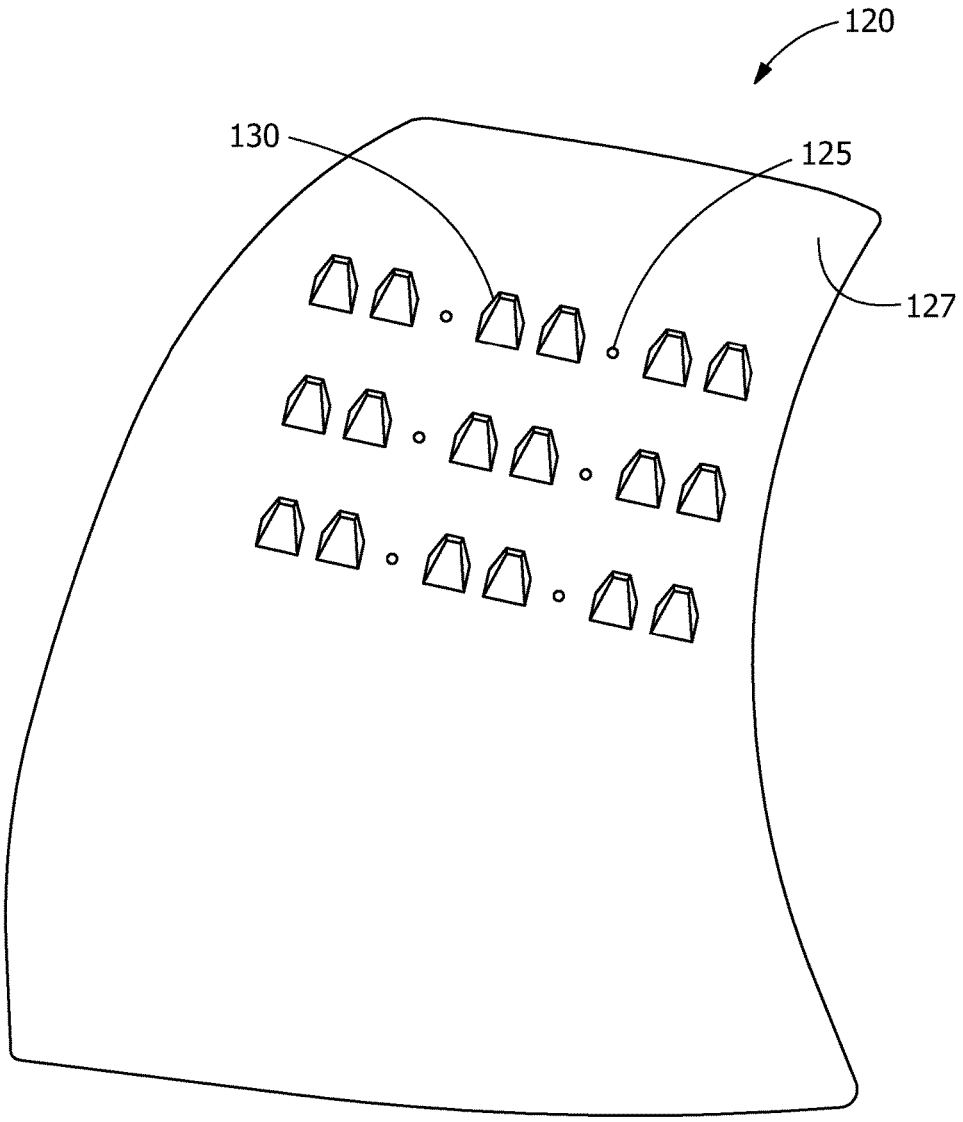
FIG. 8 is a top view of a surface of the impingement insert, according to an embodiment.

Referring to FIG. 8, in an embodiment, a single row of the impingement cooling holes 125 are substantially aligned with a substantially aligned double row of the impingement fins 130 on the first face 127 of the impingement insert 120.

Figure 9:
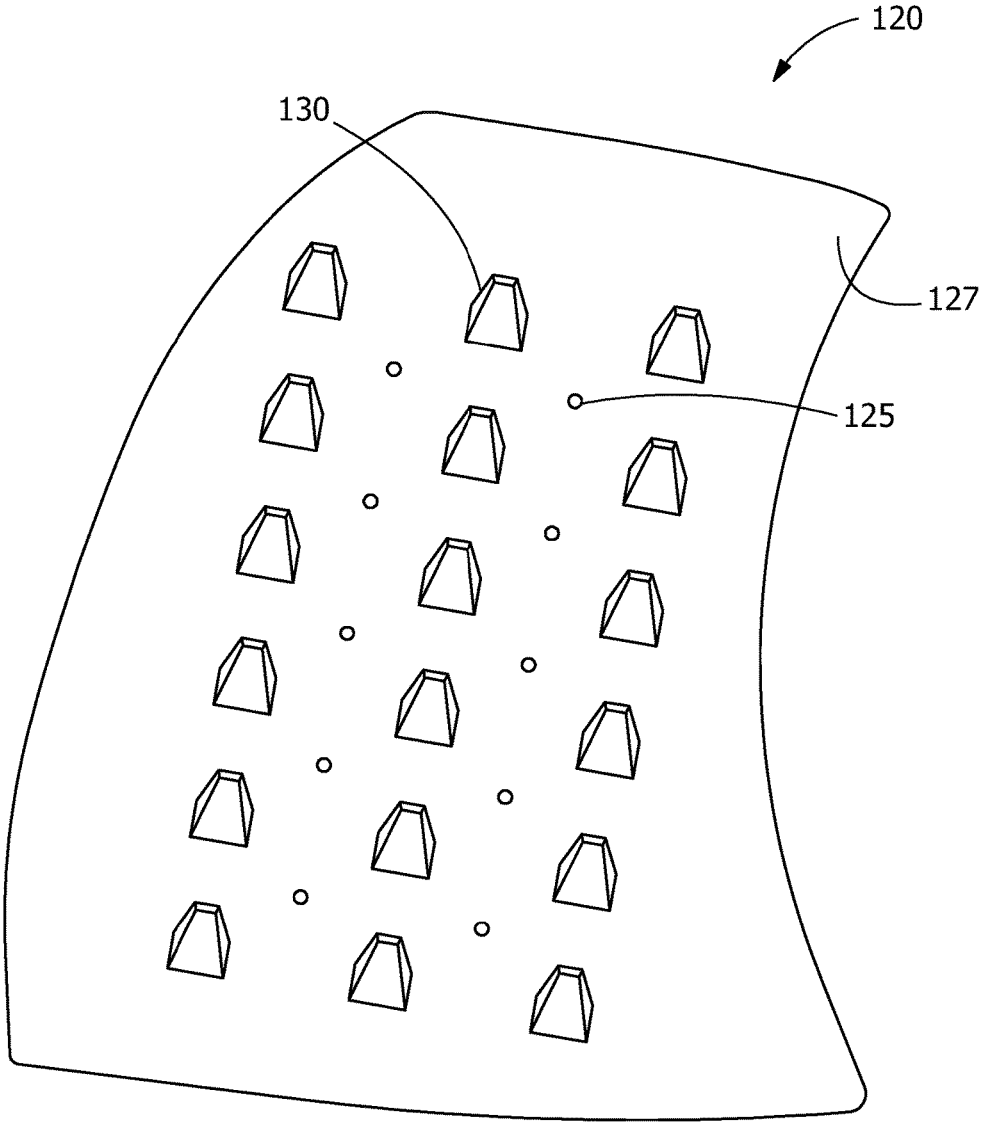
FIG. 9 is a top view of a surface of the impingement insert, according to an embodiment.

Referring to FIG. 9, in an embodiment, a single row of the impingement cooling holes 125 are offset with a single row of the impingement fins 130 on the first face 127 of the impingement insert 120.

Figure 10:
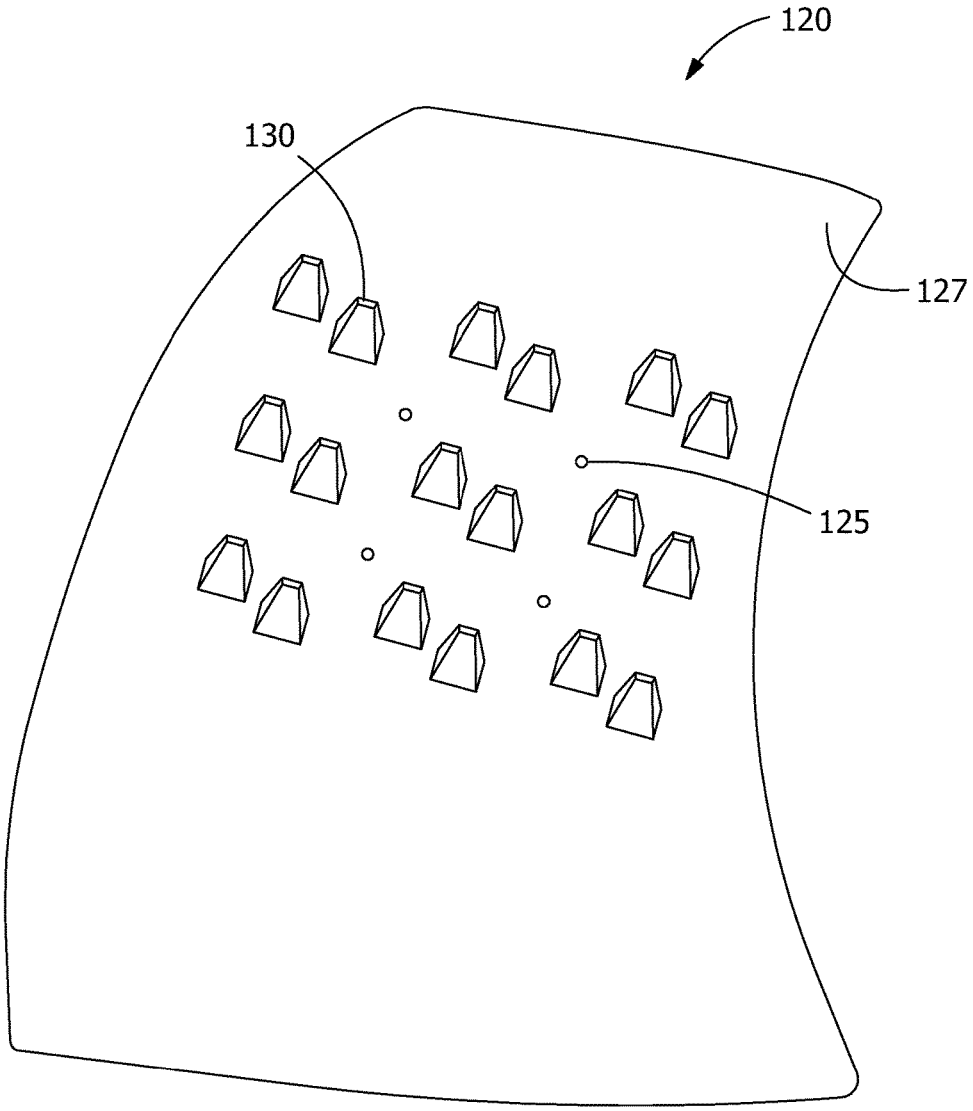
FIG. 10 is a top view of a surface of the impingement insert, according to an embodiment.

Referring to FIG. 10, in an embodiment, a single row of the impingement cooling holes 125 are offset with a staggered double row of the impingement fins 130 on the first face 127 of the impingement insert 120.

Figure 11:
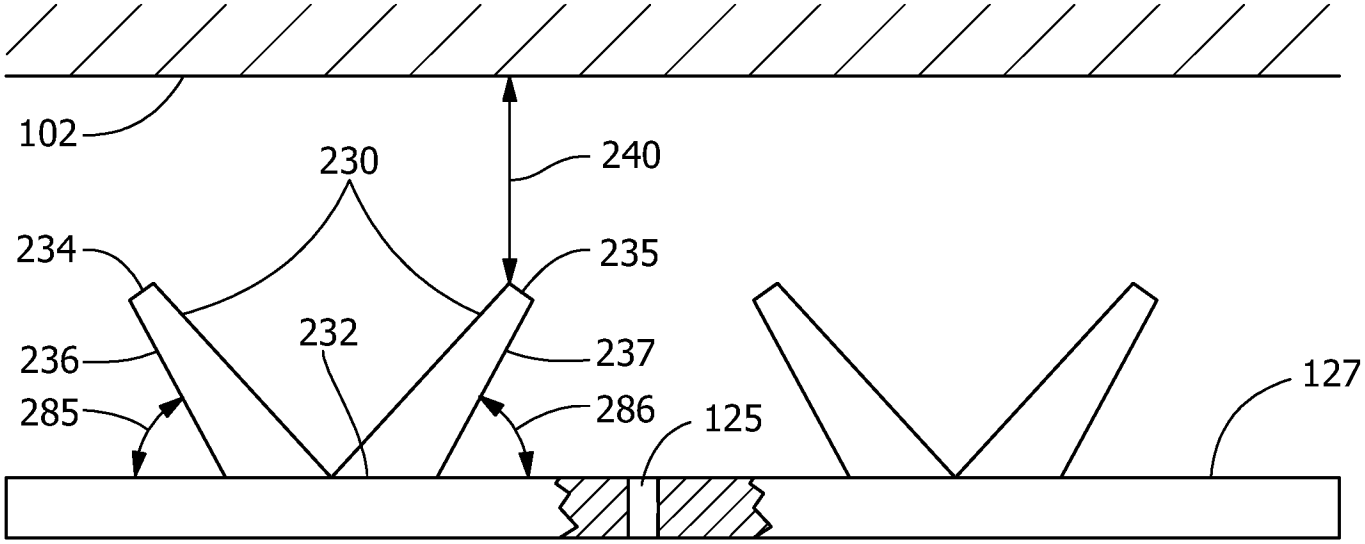
FIG. 11 is a side view of a surface of the impingement insert, according to an embodiment.
Figure 12:
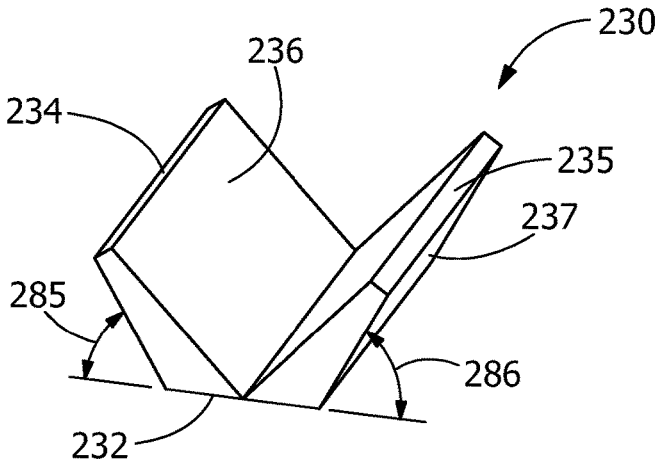
FIG. 12 is a side view of a surface of the impingement insert, according to an embodiment.
Figure 13:
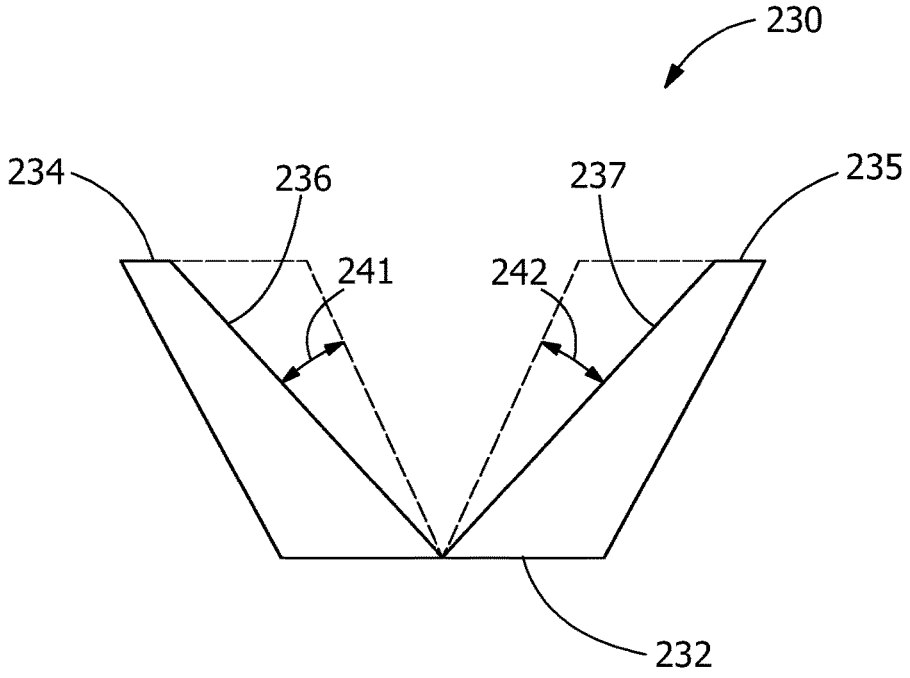
FIG. 13 is a side view of an impingement fin, according to an embodiment.

Referring to FIGS. 11, 12, and 13, in an embodiment, the impingement fin 230 includes a base 232, a first tip 234 opposite the base 232, a second tip 235 opposite the base 232, a first side 236 between the base 232 and the first tip 234, and a second side 237 between the base 232 and the second tip 235. In some embodiments, the base 232 is rectangular. In an embodiment, a width of the base 232 of the impingement fin 230 is between 0.5 millimeters to 3.0 millimeters. In some embodiments, the base 232, the first tip 234, and the second tip 235 are each rectangular. In some embodiments, the first side 236 may be tapered from the base 232 to the first tip 234 of the impingement fin 230 at a first inside angle 241. In some embodiments, the second side 237 may be tapered from the base 232 to the second tip 235 of the impingement fin 230 at a second inside angle 242. In some embodiments, an angle of the first inside angle 241 is between 3 degrees and 10 degrees, between 4 degrees and 6 degrees, and/or about 5 degrees. In some embodiments, an angle of the second inside angle 242 is between 3 degrees and 10 degrees, between 4 degrees and 6 degrees, and/or about 5 degrees. The first inside angle 241 of the taper of the first side 236 may be the same or different from the second inside angle 242 of the taper of the second side 237.

In some embodiments, the first tip 234 of the impingement fin 230 and the second tip 235 of the impingement fin 230 are spaced apart from the internal surface 102 of the airfoil 101. In an embodiment, a clearance 240 between the first tip 234 of the impingement fin 230 and the second tip 235 of the impingement fin 230 and the internal surface 102 of the airfoil 101 is between 0.5 millimeters and 2.0 millimeters. The clearance between the first tip 234 of the impingement fin 230 and the internal surface 102 of the airfoil 101 and the clearance between the second tip 235 of the impingement fin 230 and the internal surface 102 of the airfoil 101 may be the same or different.

In some embodiments, the impingement fins 230 are attached to the impingement insert 120 in a spaced apart configuration from the cooling holes 125. In some embodiments, the impingement fins 230 extend from the impingement insert 120 at a first outside angle 285 and a second outside angle 286. In some embodiments, the first outside angle 285 is greater than about 30 degrees, greater than about 40 degrees, about 45 degrees, less than about 50 degrees, less than about 60 degrees and combinations thereof. In some embodiments, the second outside angle 286 is greater than about 30 degrees, greater than about 40 degrees, about 45 degrees, less than about 50 degrees, less than about 60 degrees and combinations thereof. The first outside angle 285 may be the same or different as the second outside angle 286.

Figure 14:
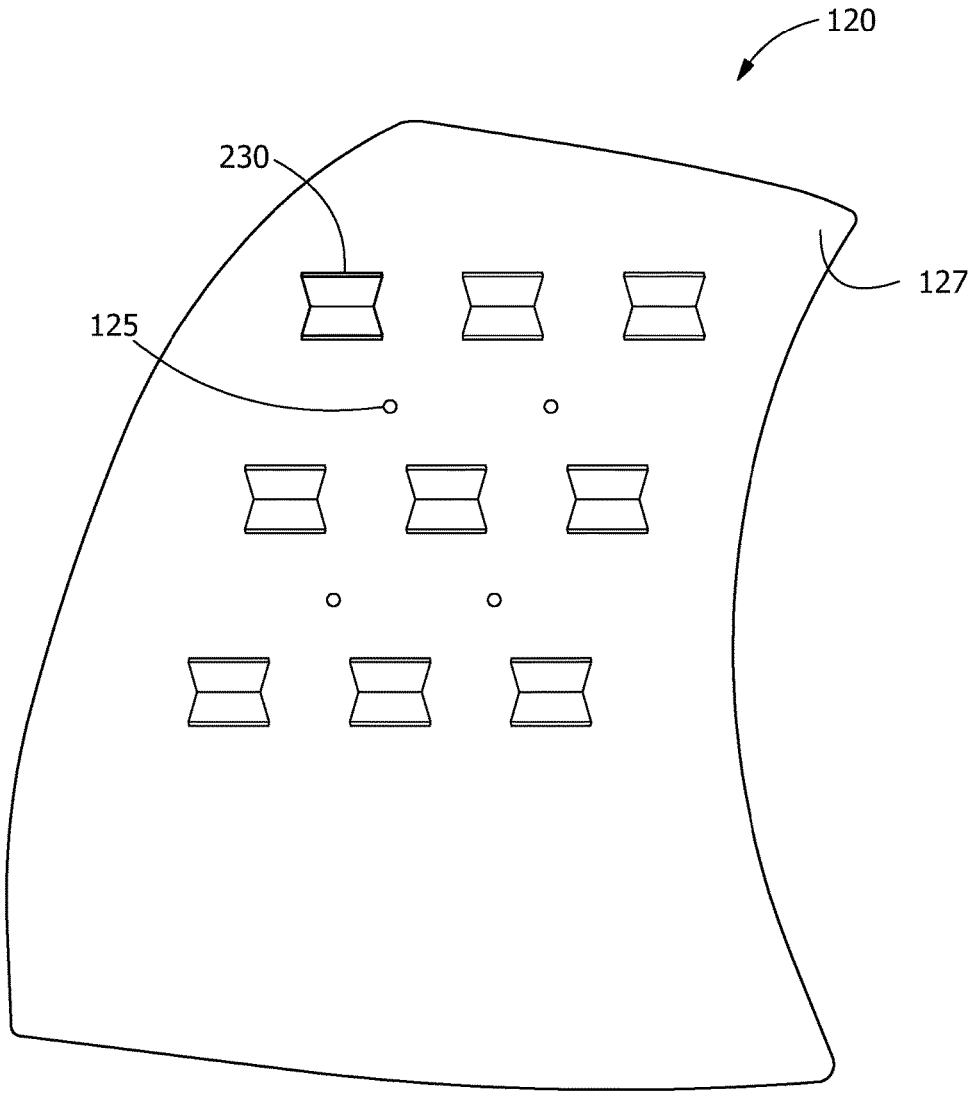
FIG. 14 is a top view of a surface of the impingement insert, according to an embodiment.

Referring to FIG. 14, in an embodiment, a single row of the impingement cooling holes 125 are offset with a single row of the impingement fins 230 on the first face 127 of the impingement insert 120.

In an alternative embodiment, one or more of the impingement fin 130 and/or one or more of the impingement fin 230 may be included with alternative turbine components in order to modify a fluid flow over the component. In some embodiments, the alternative turbine components may include a shroud or endwall. In some embodiments, the impingement fins may be directly attached to the alternative components. In some embodiments, the impingement fins may be provided to the alternative component as part of an insert. For example, the insert may be configured as a plate or bathtub which includes the one or more impingement fin 130 and/or the one or more impingement fin 230.

The impingement insert 120 may be formed by any suitable method, including, but not limited to, an additive manufacturing technique. The additive manufacturing technique may include any suitable additive manufacturing technique, including, but not limited to direct metal melting, direct metal laser sintering, selective laser melting, selective laser sintering, electron beam melting, laser metal deposition, binder jet, and combinations thereof.

While the invention has been described with reference to one or more embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims. In addition, all numerical values identified in the detailed description shall be interpreted as though the precise and approximate values are both expressly identified.

What is claimed is:

1. An impingement insert, comprising:

at least two impingement cooling holes spaced along a first face of the impingement insert and forming an impingement cooling hole row;

at least two impingement fins, each having a base and a tip opposite the base, spaced along the first face of the impingement insert and forming an adjacent impingement fin row that is offset from the impingement cooling hole row;

wherein the at least two impingement fins are spaced apart from the at least two impingement cooling holes;

wherein at least one of the at least two impingement fins forms an angle greater than 30 degrees and less than 60 degrees with the first surface of the impingement insert; and wherein any plane normal to and intersecting with a face of the at least one impingement fin forming the angle and coplanar with the impingement fin row does not intersect with a cooling hole in the adjacent impingement cooling hole row.

2. The impingement insert of claim 1, wherein the base of each of the at least two impingement fins includes a rectangular cross-section.

3. The impingement insert of claim 2, wherein a width of the rectangular cross-section of the base is between 0.5 millimeters to 2.0 millimeters.

4. The impingement insert of claim 1, wherein the angle is between 40 degrees and 50 degrees.

5. The impingement insert of claim 4, wherein the angle is between 44 degrees and 46 degrees.

6. The impingement insert of claim 1, wherein the at least two impingement fins are tapered from the base to the tip.

7. The impingement insert of claim 6, wherein the at least two impingement fins are tapered at an angle of between 3 degrees and 10 degrees.

8. The impingement insert of claim 7, wherein the at least two impingement fins are tapered at an angle of between 4 degrees and 6 degrees.

9. The impingement insert of claim 1, wherein the at least two impingement fins are attached to the impingement insert by welding, brazing, laser welding, friction welding, ultrasonic welding, additive manufacturing, and combinations thereof.

10. The impingement insert of claim 9, wherein the at least two impingement fins are attached to the impingement insert by additive manufacturing.

11. The impingement insert of claim 1, wherein the at least two impingement fins are integral to the impingement insert.

12. The impingement insert of claim 1, wherein the impingement insert further comprises:

a plurality of impingement cooling holes spaced along a second face of the impingement insert;

at least two impingement fins spaced along the second face of the impingement insert, each having a base and a tip opposite the base;

wherein the at least two impingement fins of the second face are spaced apart from the plurality of impingement cooling holes of the second face.

13. The impingement insert of claim 1, wherein the impingement cooling hole row includes a single row of the at least two impingement cooling holes in a first direction; the impingement fin row includes a single row of the at least two impingement fins in the first direction; and the at least two impingement cooling holes and the at least two impingement fins form a single mixed row of impingement cooling holes and impingement fins in a second direction different from the first direction.

14. The impingement insert of claim 1, wherein the impingement cooling hole row includes a single row of the at least two impingement cooling holes in a first direction; the at least two impingement fins comprise a plurality of impingement fins;

the impingement fin row includes a double row of the plurality of impingement fins in the first direction; and the at least two impingement cooling holes and the plurality of impingement fins form a single mixed row of impingement cooling holes and impingement fins in a second direction different from the first direction.

15. The impingement insert of claim 14, wherein the mixed row in the second direction comprises in order an impingement fin, an impingement fin, an impingement cooling hole, an impingement fin, an impingement fin, and an impingement cooling hole.

16. A component, comprising:

an airfoil having an internal surface, an external surface, a leading edge, a trailing edge, a pressure side, a suction side, and an internal impingement cavity defined by the internal surface;

an impingement insert, the impingement insert including:

at least two impingement cooling holes spaced along a first face of the impingement insert and forming an impingement cooling hole row;

at least two impingement fins, each having a base and a tip opposite the base, spaced along the first face of the impingement insert and forming an adjacent impingement fin row that is offset from the impingement cooling hole row;

wherein the at least two impingement fins are spaced apart from the at least two impingement cooling holes;

wherein at least one of the at least two impingement fins forms an angle greater than 30 degrees and less than 60 degrees with the first surface of the impingement insert; and wherein any plane normal to and intersecting with a face of the at least one impingement fin forming the angle and coplanar with the impingement fin row does not intersect with a cooling hole in the adjacent impingement cooling hole row.

17. The component of claim 16, wherein a clearance between the tip of each of the at least two impingement fins and the internal surface of the airfoil is between 0.5 millimeters and 2.0 millimeters.

18. A method of making an impingement insert, comprising:

providing the impingement insert having at least two impingement cooling holes spaced along a first surface of the impingement insert and forming an impingement cooling hole row;

forming at least two impingement fins, each having a base and a tip opposite the base, spaced along the first surface of the impingement insert by additive manufacturing, wherein the at least two impingement fins are spaced apart from the at least two impingement cooling holes and form an adjacent impingement fin row that is offset from the impingement cooling hole row;

wherein at least one of the at least two impingement fins forms an angle greater than 30 degrees and less than 60 degrees with the first surface of the impingement insert; and wherein any plane normal to and intersecting with a face of the at least one impingement fin forming the angle and coplanar with the impingement fin row does not intersect with a cooling hole in the adjacent impingement cooling hole row.

* * * * *